US006685085B2

(12) United States Patent
Hanna

(10) Patent No.: US 6,685,085 B2
(45) Date of Patent: Feb. 3, 2004

(54) TAMPER-RESISTANT FOOD CONTAINER

(75) Inventor: David M. Hanna, Richland, MI (US)

(73) Assignee: Arvco Container Corporation, Kalamazoo, MI (US)

( * ) Notice: Subject to any disclaimer, the term of this patent is extended or adjusted under 35 U.S.C. 154(b) by 0 days.

(21) Appl. No.: 10/180,376

(22) Filed: Jun. 26, 2002

(65) Prior Publication Data

US 2003/0150903 A1 Aug. 14, 2003

Related U.S. Application Data

(60) Provisional application No. 60/355,654, filed on Feb. 8, 2002.

(51) Int. Cl.[7] ..... B65D 5/00

(52) U.S. Cl. ..... 229/148; 229/906; 229/152; 229/153; 229/102

(58) Field of Search ..... 229/125.19, 152, 229/153, 142, 182.1, 102, 148, 906

(56) References Cited

U.S. PATENT DOCUMENTS

| | | | | | |
|---|---|---|---|---|---|
| 2,758,774 | A | * | 8/1956 | Grunert et al. | |
| 2,923,455 | A | | 2/1960 | Tingley | |
| 3,306,520 | A | * | 2/1967 | Allard | 229/149 |
| 3,637,131 | A | | 1/1972 | Gulliver | |
| 3,756,497 | A | | 9/1973 | Stewart | |
| 4,535,929 | A | | 8/1985 | Sherman, II et al. | |
| 4,573,633 | A | | 3/1986 | Brian | |
| 4,809,908 | A | * | 3/1989 | Keefe et al. | 229/150 |
| 4,877,178 | A | * | 10/1989 | Eisman | 229/114 |
| 4,951,865 | A | * | 8/1990 | Eisman | 229/146 |
| 5,058,803 | A | * | 10/1991 | Gulliver | 229/148 |
| 5,118,032 | A | * | 6/1992 | Geho | 229/110 |
| 5,263,634 | A | | 11/1993 | Korine | |
| 5,351,880 | A | | 10/1994 | Goudreau | |
| 5,402,929 | A | | 4/1995 | Ritter et al. | |
| 5,586,716 | A | * | 12/1996 | Correll | 229/110 |
| 5,833,130 | A | * | 11/1998 | Correll | 229/108 |
| 6,092,715 | A | | 7/2000 | Correll | |

* cited by examiner

*Primary Examiner*—Tri M. Mai
(74) *Attorney, Agent, or Firm*—Flynn, Thiel, Boutell & Tanis, P.C.

(57) ABSTRACT

A food container formed from a foldable blank of corrugated cardboard into a box-like configuration for transport and/or storage of a food product such as pizza or the like. The container incorporates therein tamper-resistant features adjacent the front corners, including a pair of inwardly foldable locking walls provided on the bottom part of the container which cooperate with upright tabs located on the top part which prevent opening of the container. An additional pair of tabs are provided on the top part of the container which block access to the folded locking walls, which tabs are then removed by the consumer to open the container.

22 Claims, 5 Drawing Sheets

TAMPER-RESISTANT FOOD CONTAINER

This application claims priority under 35 USC §119(e) of copending provisional application Ser. No. 60/355 654, filed Feb. 8, 2002, the entire disclosure of which is herein incorporated by reference.

FIELD OF THE INVENTION

This invention relates to an improved food container or box, such as for carry-out pizza, which is assembled from a foldable blank and designed specifically for preventing or at least minimizing tampering of the food stored therein.

BACKGROUND OF THE INVENTION

Tamper-proof packaging arrangements are often provided on various consumer products such as medicines, and also on packaging for various food products. These arrangements typically include locking structures which, when tampered with, enable the consumer to easily visually recognize such tampering so that the product can then be rejected. An example of such a tamper-evident structure is a plastic locking ring connected to a cap such as those utilized on beverages. When the cap is loosened to open the container, the ring disconnects from the cap and thus provides a visual clue to the consumer in the event that the container was opened by an unauthorized person. Another type of tamper-evident feature is a plastic strip or seal which is provided externally around an opening of a container which must be removed or torn off prior to opening the container. If this strip is missing or damaged, the consumer can reject the product. In both of the above arrangements, the tamper-evident structure essentially locks the container in the closed position, and opening of the container can only be achieved by damaging or removing the locking structure.

Food containers formed from blanks incorporating locking arrangements for securing the walls of the container are conventional. In this regard, U.S. Pat. Nos. 4,573,633 and 6,092,715 disclose food boxes or containers utilizing locking arrangements. The '633 patent is directed to a paperboard baking and shipping tray having locking flaps formed on the respective upright side panels. The opposite upright end panels define corner-shaped detents which are pressed inwardly and once in place prevent outward movement of the side panels relative to the upright end panels. The '715 patent discloses a pizza box wherein flaps are attached to the upright edges of the side and front walls and define the front corners of the box. These flaps are folded inwardly and interlocked with one another by means of a tab defined on one flap and which abuts a shoulder defined on the other flap. However, neither of these arrangements includes any tamper-resistant features, and neither provides the consumer with any type of visual cue as to whether the container has been tampered with.

The present invention relates to a container or box for carrying, transporting or storing food, such as pizza or the like. The container is formed by folding a one-piece blank, and includes a locking arrangement which prevents unauthorized opening of the box by someone other than the consumer, and when tampered with enables the consumer to visually recognize same.

More specifically, the container or box pursuant to the invention incorporates therein tamper-resistant features located at the two front corners of the closed container. In this regard, the top wall of the container is attached to a pair of side walls or flaps which define locking tabs. These locking tabs cooperate with respective locking walls defined in side flaps attached to the bottom wall of the container. The locking walls are folded during assembly of the bottom of the container so that the locking walls are essentially corner-shaped and so that the corners thereof are disposed outwardly. After the food item, such as a pizza, is placed in the bottom of the container, the top is then lowered and the side flaps attached to the top wall are tucked inside and superimposed over the respective upright side flaps of the bottom. The locking walls are then pushed inwardly past the respective upright locking tabs to form a corner shape which is reversed in configuration from the initial corner shape.

The upright locking tabs essentially wrap around the respective lower edges of the locking walls and effectively prevent upward movement of the top of the container by abutting against the lower edges of the locking walls, thereby preventing opening of the container after the locking walls are pushed inwardly. The top wall defines a pair of lobe-shaped removable tabs which extend in a generally perpendicular manner over the top edges of the respective locking walls when the container is fully assembled and closed. These lobe-shaped tabs are intended for removal by the consumer along perforations, and once removed allow easy manipulation of the locking walls to open the container. That is, the lobe-shaped tabs are removed by tearing same along the perforations, and the locking walls are pushed outwardly or forwardly past the respective upright locking tabs so that the container can easily be opened. Thus, someone attempting to tamper with the contents of the container would essentially have to pry or pull the locking walls outwardly past the locking tabs, or remove the lobe-shaped tabs from the top wall to gain access to the locking walls. The prior removal of the tabs would then allow easy visual recognition of tampering.

Other objects and purposes of the invention will be apparent to persons familiar with arrangements of this general type upon reading the following specification and inspecting the accompanying drawings.

Figures 1, 2, 3:
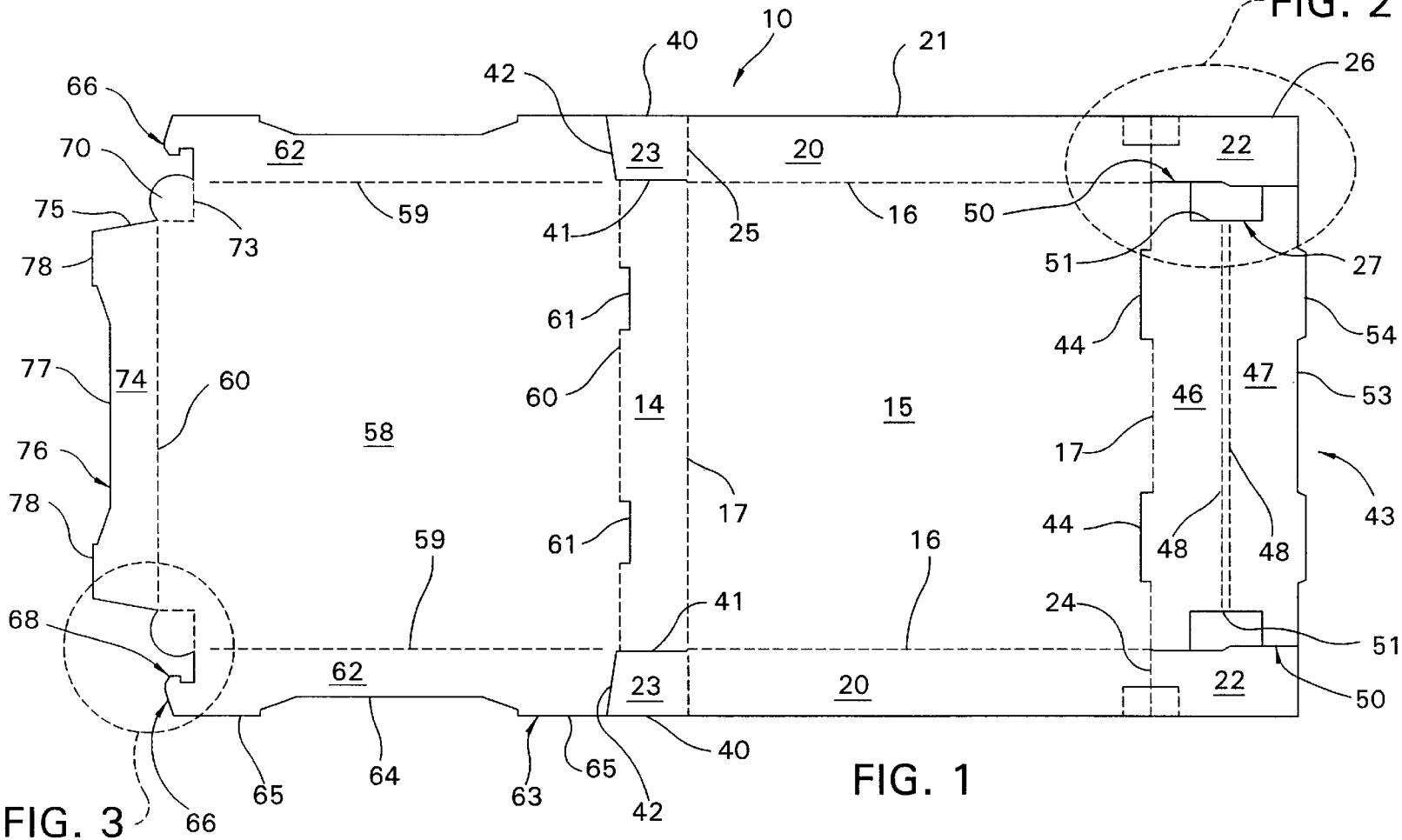
FIG. 1 is a plan view of an unfolded, flat, one-piece blank used for preparing the container according to the present invention.
FIG. 2 is an enlarged detail view of an area of the blank of FIG. 1 from which the locking walls are formed.
FIG. 3 is an enlarged detail view of an area of the blank of FIG. 1 from which the lobe-shaped tabs are formed.
Figure 2:
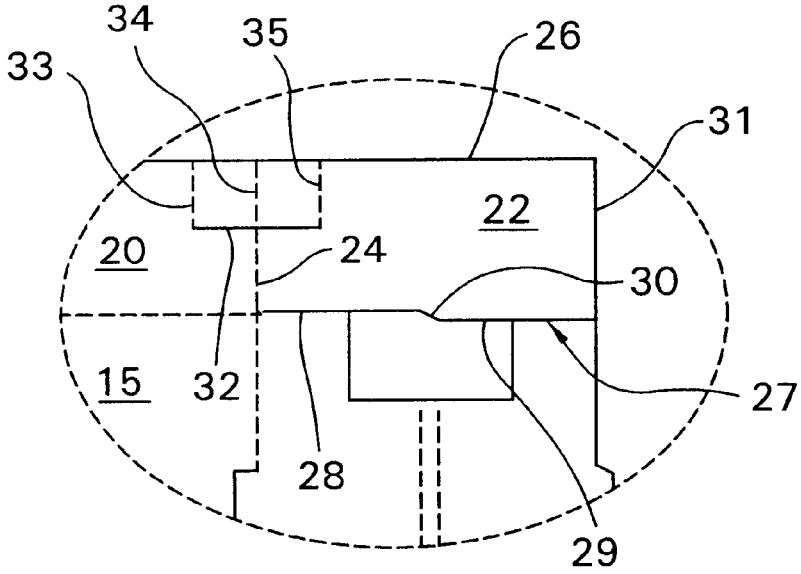
Figure 3:
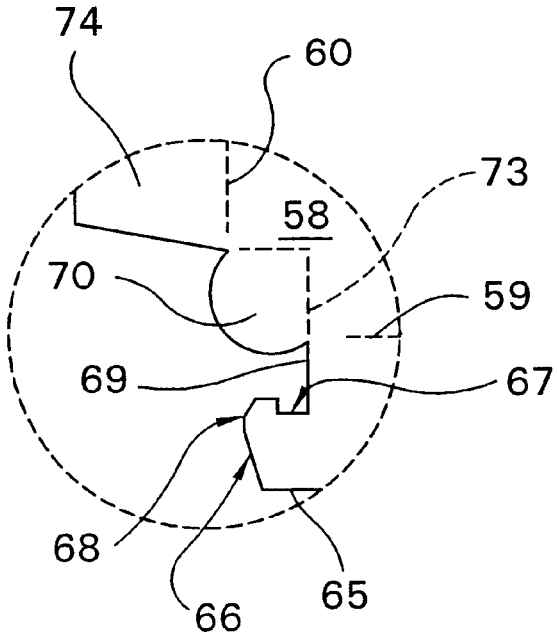
Figure 7:
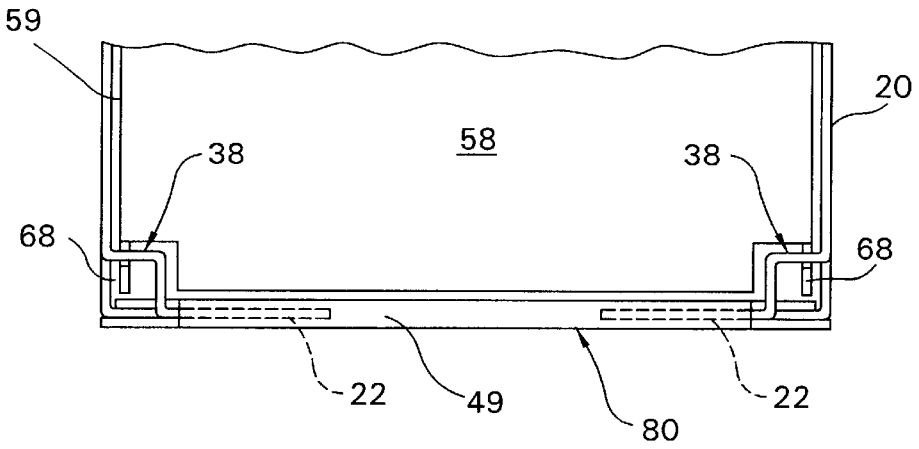
FIG. 7 is a top view of the container in a fully closed configuration and after removal of the lobe-shaped tabs.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center and designated parts thereof. Said terminology will include the words specifically mentioned, derivatives thereof, and words of similar import.

DETAILED DESCRIPTION

Referring to FIG. 1, the present invention is directed to a flat blank 10 preferably constructed from stiff double-sided corrugated cardboard having a corrugated interior layer bonded between a pair of flat facing layers, which layers are all of rather thin paper. However, the blank 10 may also be constructed of single-sided corrugated cardboard having a corrugated layer bonded to a single flat facing layer, with the corrugated layer facing inwardly toward the food product. The blank 10 is prepared using techniques which are conventional and well known in the box forming industry.

The blank 10 is foldable into the shape of a box or container 11 (FIG. 6) suitable for carrying a food product, such as pizza. The container 11 includes a bottom part or base 12 and a top part or lid 13 which are joined together by rear wall 14 so as to permit closure of the container 11 and creation of a closed compartment therein.

The blank 10 (FIG. 1) is a flat and generally planar, monolithic, one-piece element and defines a bottom wall 15 which forms part of the base 12 and has the general shape of a square. Bottom wall 15 includes a pair of generally parallel first side edges 16 and a pair of generally parallel second side edges 17, the latter extending generally perpendicularly between the side edges 16. All of the side edges 16 and 17 are defined by fold lines shown in dotted lines in FIG. 1.

The blank 10 also includes a pair of elongate side wall parts 20 which join to opposite side edges 16 at the fold lines thereof. A free edge 21 of each side wall part 20 extends generally parallel with the fold line 16, the latter defining the inner or lower edge of the side wall part 20. The blank 10 further includes a pair of additional front and rear wall parts 22 and 23 which effectively function as flaps and project or extend outwardly in cantilevered relationship from opposite ends of a respective side wall part 20. Each flap 22 and 23 is joined an end of the respective side wall part 20 through fold lines 24 and 25, respectively. Each fold line 24 and 25 extends substantially throughout the width of the side wall part 20 and constitute extensions of the respective fold lines 17. In the assembled condition of the container 11, the fold lines 24 and 25 respectively define front and rear corners of the container 11.

The flap 22 is defined by a pair of outer and inner free edges 26 and 27, both of which are substantially perpendicular to fold line 24. Inner free edge 27 is defined by first and second edge portions 28 and 29 which are joined to one another through an angled portion 30 such that second edge portion 29 is spaced further from free edge 26 than first edge portion 28. Outer free edge 26 is an extension of free edge 21. First and second edge portions 28 and 29 are generally parallel to outer free edge 26. Flap 22 is further defined by a forward free edge 31 which is substantially parallel to fold line 24.

As shown in detail in FIG. 2, cut lines 32 are provided in the respective side wall parts 20 and the adjoining front wall parts 22. Cut line 32 transversely intersects fold line 24 and is bisected thereby. Fold lines 33, 34 and 35 which are generally parallel to one another extend outwardly from cut line 32 to the respective free edges 21 and 26. The centermost cut lines 34 are extensions of the respective fold lines 24. In the assembled condition of the container 11, the cut lines 32 and the corresponding fold lines 33, 34 and 35 define locking walls 38 which lock the container 11 in a closed configuration.

Rear wall part or flap 23 is defined by an outermost or top free edge 40, an inner free edge 41 which is generally parallel to outer free edge 40, and a rear free edge 42 which extends transversely between edges 40 and 41.

Figure 4:
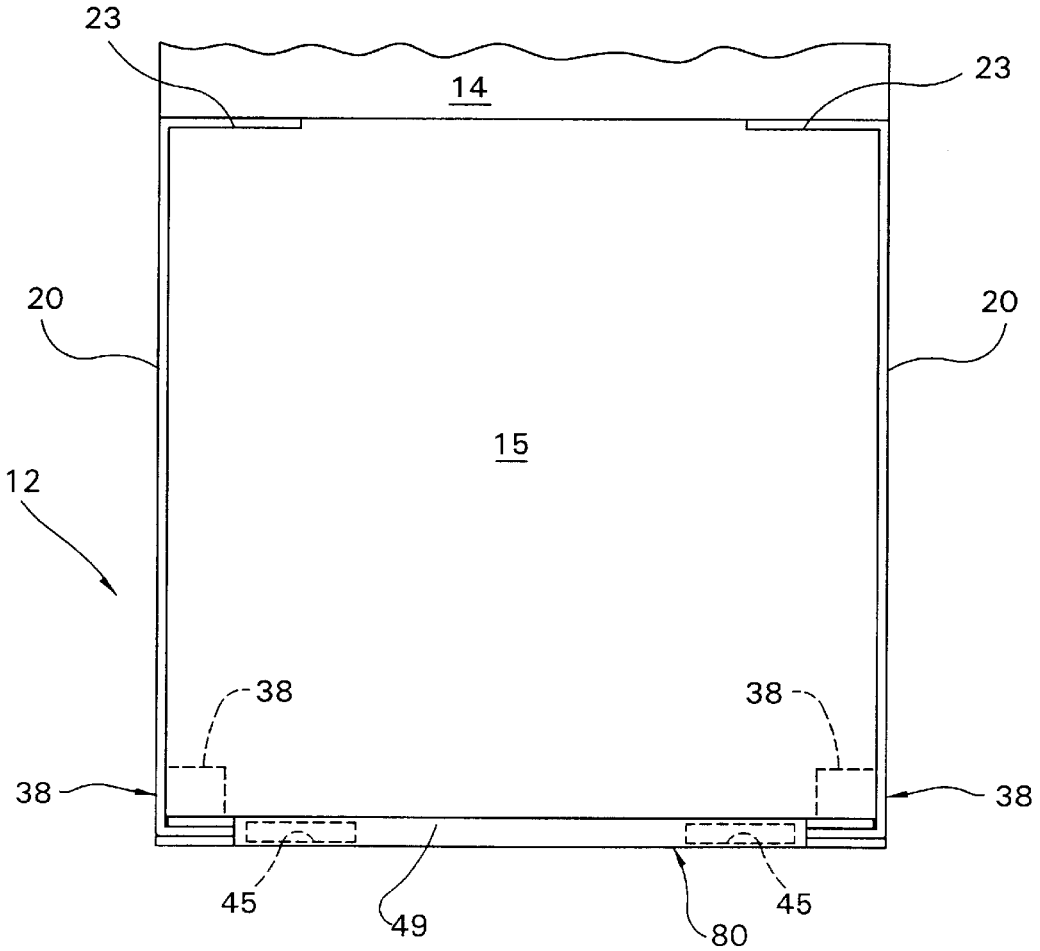
FIG. 4 is a fragmentary, enlarged top view of the bottom of the container formed from the blank of FIG. 1 in a partially assembled configuration.

Blank 10 additionally includes a front flap 43 which is joined to the front side of bottom wall 15 through fold line 17. Cut lines 44 each in the shape of a partial rectangle are located along fold line 17 in a spaced-apart manner from one another. When front flap 43 is folded upwardly along fold line 17 as discussed below, cut lines 44 result in the formation of openings or slots 45 adjacent front fold line 17 (FIG. 4). Front flap 43 is defined by inner and outer flap portions 46 and 47 joined to one another through a pair of generally parallel and slightly spaced-apart fold lines 48, which are also generally parallel to fold line 17. When the front flap 43 is folded along fold lines 48, a flat upper edge wall portion 49 is formed. Front flap 43 further includes a pair of free side edges 50, each of which defines an inwardly projecting cut-out section 51 in the shape of a partial rectangle. When the inner and outer flap portions 47 and 48 are folded over upon one another, the cut-out sections 51 result in inwardly recessed areas or shoulders 52 disposed adjacent the respective locking walls 38 at opposite front corners of the assembled container 11. Front flap 43 also includes an outer free edge 53 which is generally parallel to front fold line 17 and defines the outer extent of outer flap portion 47. Free edge 53 defines thereon a pair of outwardly projecting tabs 54 which are opposite the respective cut lines 44 and are sized for insertion into the openings 45 defined thereby when the container 11 is assembled after folding of the inner and outer flap portions 46 and 47 along fold lines 48.

The top part 13 of the container 11 is embodied by a top wall 58 having a generally square configuration and is similar in size to bottom wall 15. Top wall 58 includes a pair of generally parallel first side edges 59 and a pair of generally parallel second side edges 60, the latter extending generally perpendicular relative to side edges 59. Side edges 59 and 60 are defined by fold lines shown in dotted lines in FIG. 1. Side edges 60 are generally parallel with side edges 17 of bottom wall 15, and side edges 59 constitute extensions of the respective side edges 16 as interrupted by the respective inner free edges 41 of flaps 23. A pair of partially rectangular cut lines 61 are provided in a spaced-apart manner along inner side edge 61 which result in vent holes or openings after folding of the top wall 58 along fold line 60.

Blank 10 additionally includes a pair of elongate side wall parts or flaps 62 which form part of top part 13 and which join to opposite side edges 59 at the fold lines thereof. Each side wall part 62 terminates in a free edge 63 which defines therein an inwardly projecting recess 64 bordered on opposite sides thereof by a pair of straight edge portions 65. Inner edge portion 65 is an extension of outer free edge 40 but is separated therefrom by the cut line which defines edge 42, and outer edge portion 65 is joined to an outer free edge portion 66 which extends transversely relative thereto. Free edge portion 66 is recessed at 67 (FIG. 3) such that a cantilevered locking tab 68 is defined on each side wall part 62. An inner free edge 69 projects away from recess 67 and is generally perpendicular to side edge or fold line 59. Each free edge 69 is joined to a lobe-shaped tab 70, which tabs 70 effectively define the respective front upper corners of the assembled container 11 (see FIG. 6). A generally corner-shaped perforation 73 defines the inner extent of each of the tabs 70 and allows for removal thereof as discussed below.

Top part 13 further includes an outer flap 74 which is joined to top wall 58 through fold line 60. Outer flap 74 includes a pair of angled free side edges 75 which are joined to the respective lobe-shaped tabs 70, and an outer free edge 76 which extends between side edges 75. Edge 76 is recessed at 77, and a pair of straight edge portions 78 are located on opposite sides of recess 77 similarly to the configuration of side flaps 62.

The blank 10 will normally be maintained in the flat condition illustrated by FIG. 1, which facilitates compact shipping and storage thereof. When use is desired, the blank 10 may be assembled for the purpose of storing and transporting a food product as discussed in detail below.

To assemble the blank 10 into the container 11, the side wall parts 20 are initially manually folded upwardly about fold lines 16, and at about the same time the respective pairs of flaps 22 and 23 are folded inwardly and towards one another about the respective fold lines 24 and 25. The front flap 43 is then folded upwardly about front fold line 17 and at about the same time, the flaps 22 are folded further inwardly until the edges 27 thereof lie substantially along and engage front side edge 17. In this regard, edge portions 29 of the respective flaps 22 seat or are engaged within the respective openings 45 created by cut lines 44 after folding of the front flap 43. Outer flap portion 47 is then folded downwardly about fold lines 48 over the respective flaps 22 and the tabs 54 of outer free edge 53 are also tucked into the respective openings 45. The double fold lines 48 allow the inner and outer flap portions 46 and 47 to be slightly horizontally spaced from one another such that flaps 22 are sandwiched between the now upright inner and outer flap portions 46 and 47 of front flap 43. The front flap 43 thus wraps around flaps 22, and along therewith forms a rigid front wall 80 as illustrated in FIG. 4.

Figure 5:
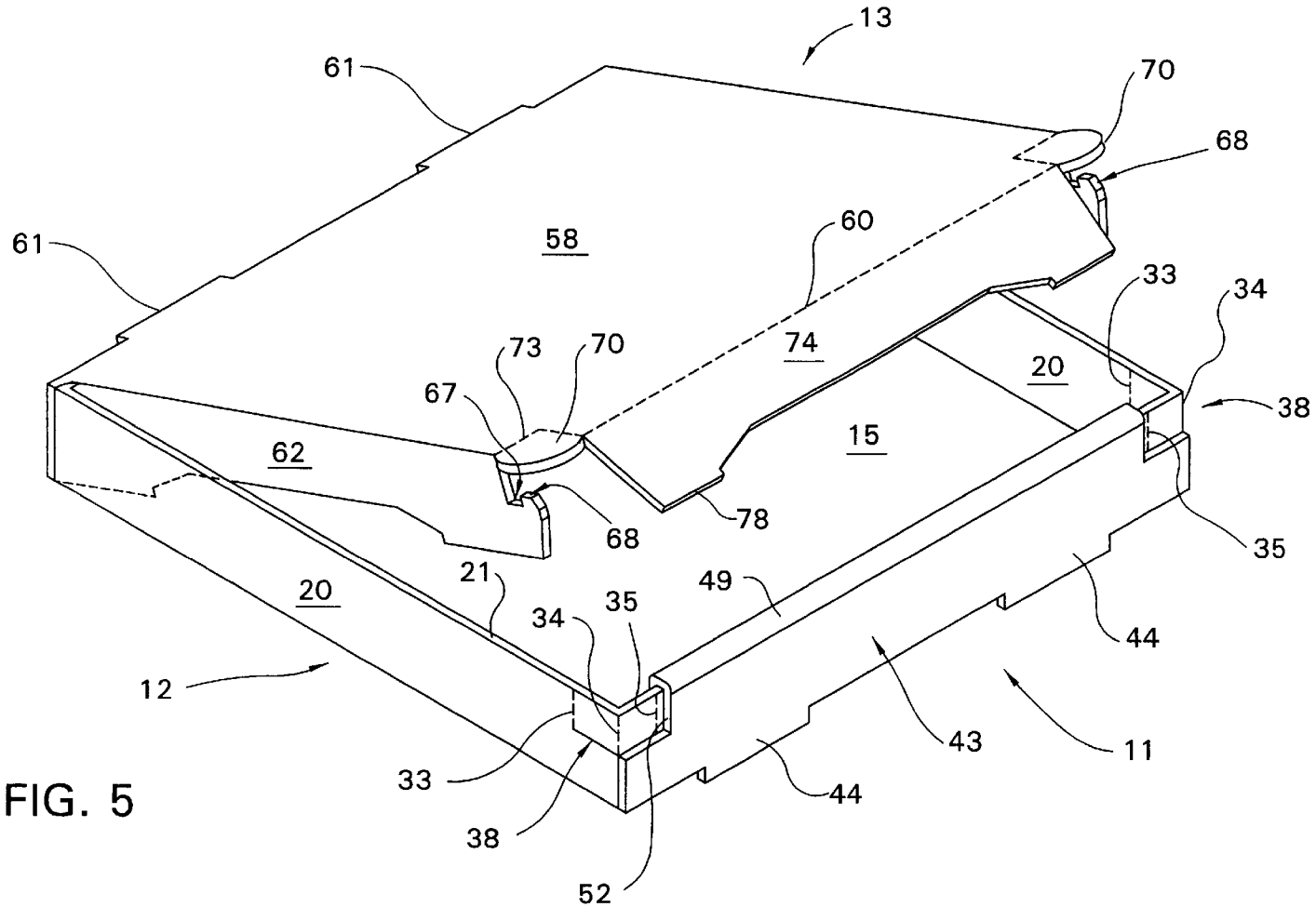
FIG. 5 is a perspective view of the container in a partially closed configuration.

With rear flaps 23 in a partially folded configuration, the rear wall 14 is folded upwardly about fold line 17 which serves to push flaps 23 further inwardly. As the rear wall 14 is folded upwardly, the top part 13 is swung upwardly and forwardly and is folded about the fold line 60, and substantially simultaneously therewith side wall parts 62 are folded inwardly about their fold lines 59 and are tucked inside the respective upright side wall parts 20 of bottom part 12. This partially closed configuration of the container 11 is illustrated in FIG. 5.

To complete closure of the container 11, the outer flap 74 of top part 13 is folded downwardly about fold line 60, and the top part 13 is swung downwardly until the free edge 76 is tucked inside the front wall 80 so that the straight edge portions 78 lie along front fold line 17. During this downward swinging movement of top part 13, the side wall parts 62 slide downwardly against the respective side wall parts 20 until the straight edge portions 65 lie along the respective fold lines 16 of bottom wall 15, and the respective locking tabs 68 project generally upwardly adjacent the respective locking walls 38 at the front corners of the container 11.

Figure 6:
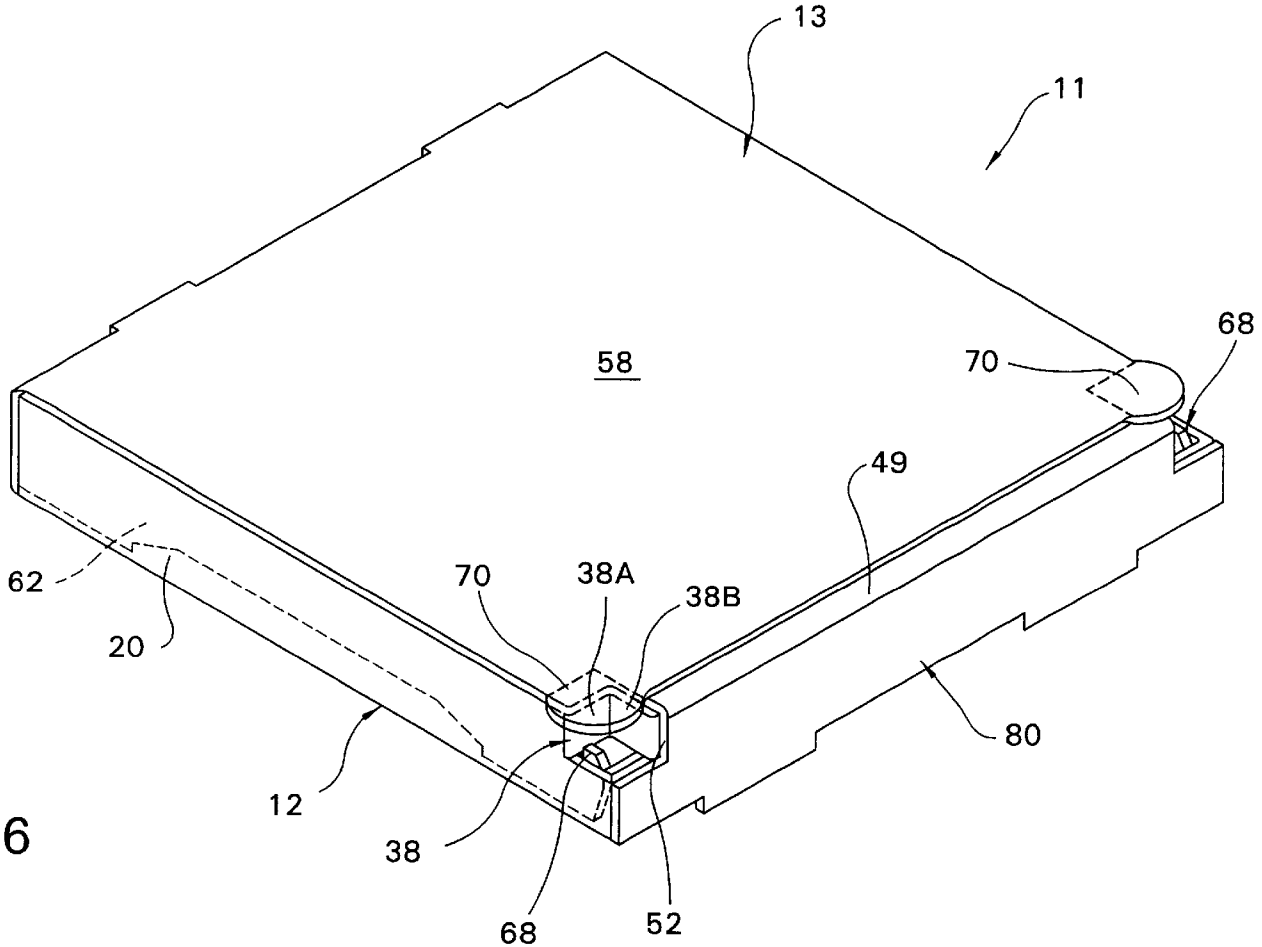
FIG. 6 is a perspective view of the container in a fully closed configuration.

To lock the container 11, the locking walls 38 at the front corners of the container 11 are folded or pushed inwardly and past the respective upright locking tabs 68 and folded along the respective fold lines 33, 34 and 35 into the position shown in FIG. 6 and in dotted lines in FIG. 4, so that the locking walls 38 define first and second locking wall parts 38A and 38B which are generally perpendicular to one another. In this position, the tabs 68 wrap around the lower edges of the respective locking walls 38 and abut or engage against the outer forwardly facing surface of locking wall parts 38A, and the lobe-shaped tabs 70 are positioned above the respective locking walls 38. Thus, upward lifting of the top part or lid 13 is prevented by the locking walls 38 which engage within respective recesses 67 and act as stops.

In order to open the container, the consumer simply tears off the tabs 70 along perforations 73 which exposes the upper edges of the locking walls 38 so that a finger can be inserted behind each of the walls 38. The walls 38 are then pushed outwardly past the locking tabs 68 back into their initial pre-locked positions (FIG. 5). Once the locking walls 38 are disengaged from their respective tabs 68, then the top part 13 of the container 11 can be pivoted upwardly about fold line 60 to provide access to the food product stored within container 11.

Prior to when the food product reaches the consumer, the upright tabs 68 effectively prevent outward movement of the respective locking walls 38 (i.e. into their initial positions shown in FIG. 5), and the tabs 70 block access to the inwardly folded locking walls 38. These features prevent or at least minimize tampering of the food product stored within the container 11. More specifically, one attempting to gain access to the interior of the closed container 11 would have to tear off the tabs 70 to access the locking walls 38. This removal of the tabs 70 would be readily apparent to the consumer. An unauthorized person may also attempt to open the container 11 by prying the locking walls 38, for example by inserting an object behind the walls 38 on either side of the tab 70 and pulling outwardly. However, this type of tampering would provide visual clues to the consumer, in that the areas adjacent the front corners of the container 11 would appear ragged, creased, etc.

Although a particular preferred embodiment has been disclosed in detail for illustrative purposes, it will be recognized that variations or modifications of the disclosed apparatus, including the rearrangement of parts, lie within the scope of the present invention.

I claim:

1. A food container comprising:

upper and lower portions joined to one another such that said upper portion is pivotably swingable away from said lower portion to define an open configuration of said container and toward said lower portion to define a closed configuration of said container;

said lower portion comprising:

a generally planar bottom wall having a first pair of generally parallel side edges and a second pair of generally parallel side edges extending generally perpendicular relative to said first pair of side edges;

first and second elongate side walls integrally joined to said bottom wall and folded upwardly therefrom about fold lines which extend along said first pair of side edges;

front and rear side walls integrally joined to said bottom wall and folded upwardly therefrom about fold lines which extend along said second pair of side edges, opposite ends of said front side wall along with adjacent front ends of said first and second side walls forming a pair of front corners of said container; and a pair of locking walls, each said locking wall being disposed adjacent one of said front corners and being folded inwardly towards an interior of said container;

said upper portion comprising:

a generally planar top wall having a first pair of generally parallel side edges and a second pair of generally parallel side edges extending generally perpendicularly relative to said first pair of top wall side edges, said top wall being integrally joined to said rear side wall about a fold line which extends along one of said first top wall side edges; and first and second elongate side walls integrally joined to said top wall and folded downwardly therefrom about fold lines which extend along said second top wall side edges, each said first and second side wall of said upper portion having a front end portion adjacent one of aid front corners which defines a locking tab, said locking tabs engaging with lower edges of the respective locking walls to prevent upward movement of said upper portion relative to said lower portion, and said locking tabs having generally upwardly projecting portions respectively positioned adjacent forwardly facing surfaces of the respective locking walls.

2. The container of claim 1 wherein said upper portion defines thereon a pair of tabs adjacent the respective front corners above the respective locking walls to block access thereto and prevent outward movement of the locking walls forwardly past the respective upright locking tab portions.

3. The container of claim 1 wherein each said locking tab defines an upwardly opening recess therein and the respective locking tab portion is disposed closely adjacent and forwardly of said recess, said lower edge of the respective locking wall being engaged within said recess and said locking tab portion being positioned adjacent said forwardly facing surface of said locking wall prevents outward movement thereof.

4. The container of claim 3 wherein said upper portion defines thereon a pair of tabs adjacent the respective front corners, each said tab being disposed above a respective locking wall to block access thereto and prevent unauthorized opening of said container.

5. The container of claim 4 wherein said tabs are perforated to allow removal by the consumer, and once removed allow manipulation of the respective locking walls.

6. The container of claim 1 wherein each said first and second side wall of said lower portion includes a front flap integrally joined thereto and extending outwardly from a front end portion thereof, each said flap being folded inwardly about a vertical flap fold line such that said flaps are superimposed on an inside surface of said front side wall, each said first and second side wall of said lower portion and the corresponding flaps defining therein a cut line which is bisected by the corresponding flap fold line to define the respective locking walls, each said locking wall being folded inwardly along a central fold line which is an extension of said flap fold line and a pair of outer fold lines disposed on opposite sides of said central fold line and generally parallel thereto to provide said locking wall with an inwardly projecting corner-shape which extends between said front side wall and the respective side wall of said lower portion.

7. The container of claim 6 wherein said locking tabs each define an upwardly opening recess therein and the respective locking tab portion is disposed closely adjacent and forwardly of said recess, said lower edge of the respective locking wall being engaged within said recess and said locking tab portion being engaged with a forwardly facing surface of said locking wall to prevent outward movement thereof, said upper portion defines thereon a pair of tabs adjacent the respective front corners, and each said tab being disposed above and in generally perpendicular relation with a respective locking wall to block access thereto and prevent unauthorized opening of said container.

8. A tamper-resistant food container comprising:

generally horizontally oriented top and bottom parts, said top part being pivotably movable towards and away from said bottom part to define closed and open configurations of said container, respectively, said top and bottom parts being disposed in opposed relation with one another in said closed configuration of said container;

front and rear generally upright side walls extending vertically between front and rear edge portions of said top and bottom parts, respectively, and first and second generally upright side walls extending vertically between opposed pairs of side edge portions of said top and bottom parts, opposite ends of said front side wall along with adjacent front ends of said first and second side walls forming a pair of front corners of said container; and a pair of locking arrangements each disposed adjacent one of said front corners, each said locking arrangement including a locking wall defined on said bottom part which is foldable inwardly towards an interior of said container into a locked position which prevents movement of said top part into said open configuration and outwardly away from the interior into an unlocked position which allows movement of said top part into said open configuration, locking tab defined on said top part, each said locking tab engaging with one of said locking walls when in the locked position to prevent upward movement of said top part relative to said bottom part, and a sidewardly projecting tab positioned above one of said locking walls to block access thereto and prevent movement of same by an unauthorized person into the unlocked position.

9. The food container of claim 8 wherein said locking tabs are disposed to respectively engage with lower edge portions of said locking walls upon upward movement of said top part relative to said bottom part.

10. The food container of claim 8 wherein said container is constructed entirely from a one-piece blank of sheet-like corrugated material.

11. The food container of claim 8 wherein said tabs are perforated to allow removal of same by the consumer, and once removed permit access to said locking walls to permit movement of same into the unlocked position and allow movement of said top part into said open configuration.

12. The food container of claim 8 wherein each said locking tab is oriented in a generally upright manner and is positioned adjacent a forwardly facing surface of the respective said locking wall to prevent same from being pushed outwardly and forwardly into the unlocked position.

13. The food container of claim 8 wherein each said locking wall includes preformed fold lines thereon to permit same to be folded into the locked position so as to define an inwardly projecting corner-shaped configuration defined by first and second upright locking wall parts oriented in generally perpendicular relation with one another, and into the unlocked position so as to define an outwardly projecting corner-shaped configuration wherein said first and second locking wall parts are oriented in generally perpendicular relation with one another.

14. The food container of claim 13 wherein each said locking tab is oriented in a generally upright manner and engages a forwardly facing surface of one of said first and second locking wall parts of the respective said locking wall to prevent same from being pushed outwardly and forwardly into the unlocked position.

15. A food container comprising:

upper and lower portions joined to one another such that said upper portion is pivotably swingable away from said lower portion to define an open configuration of said container and toward said lower portion to define a closed configuration of said container;

said lower portion comprising:

a generally planar bottom wall having a first pair of generally parallel side edges and a second pair of generally parallel side edges extending generally perpendicular relative to said first pair of side edges;

first and second elongate side walls integrally joined to said bottom wall and folded upwardly therefrom about fold lines which extend along said first pair of side edges;

front and rear side walls integrally joined to said bottom wall and folded upwardly therefrom about fold lines which extend along said second pair of side edges, opposite ends of said front side wall along with adjacent front ends of said first and second side walls forming a pair of front corners of said container; and a pair of locking walls, each said locking wall being disposed adjacent one of said front corners and being folded inwardly towards an interior of said container;

said upper portion comprising:

a generally planar top wall integrally joined to said rear side wall about a fold line which extends along a side edge of said top wall;

a pair of locking tabs, said locking tabs abuttingly engaging with lower edges of the respective locking walls when an attempt is made to raise said upper portion relative to said lower portion; and a pair of generally horizontally projecting tabs respectively positioned above said locking walls to block access thereto and prevent same from being moved outwardly past the respective locking tabs.

16. The food container of claim 15 wherein said top wall has a first pair of generally parallel side edges and a second pair of generally parallel side edges extending generally perpendicularly relative to said first pair of top wall side edges, said fold line which joins said top wall to said rear side wall extending along one of said first top wall side edges, said upper portion including first and second elongate side walls integrally joined to said top wall and folded downwardly therefrom about respective fold lines which extend along said second top wall side edges, each said first and second side wall of said upper portion having a front end portion adjacent one of said front corners, said locking tabs being defined on the respective front end portions of said first and second side walls.

17. A tamper-resistant food container formed from a one-piece foldable blank, said container comprising:

top and bottom portions disposed in opposed relation with one another in a closed configuration of said container and wherein said top portion is hingedly attached to said bottom portion through a fold line and is swingably movable away from same to define an open configuration of said container;

a plurality of upright side walls projecting between said top and bottom portions with adjacent pairs of said side walls being oriented in transverse relation with one another; and a locking arrangement including a generally upright wall which is foldable into a locked position wherein said wall is generally corner-shaped with the corner thereof being disposed inwardly to prevent said top portion from being moved away from said bottom portion, and into an unlocked position wherein said corner is disposed outwardly, and a generally horizontally oriented tab which is disposed above said wall and in generally perpendicular relation therewith to block access to said wall and prevent same from being moved into the unlocked position by an unauthorized person, said tab being perforated to permit removal of said tab by the consumer to provide access to said wall and allow movement of said wall into the unlocked position, and removal of said tab by an unauthorized person provides visual evidence of tampering.

18. The container of claim 17 wherein said wall is defined on said bottom portion and a locking tab is defined on said top portion and is disposed such that in the locked position of said wall, said locking tab prevents both upward movement of said top portion and outward movement of said wall into the unlocked position.

19. The container of claim 18 wherein a pair of corners are respectively defined by two pairs of transversely oriented side walls and a said locking arrangement is disposed adjacent each said corner of said container.

20. The container of claim 17 wherein said wall is movable inwardly into locking engagement with said top portion into said locked position to prevent upward lifting of said top portion relative to said bottom portion.

21. The container of claim 20 wherein said locking arrangement includes a locking member defined on said top portion which is disposed to engage a lower edge of said wall to prevent raising of said top portion relative to said bottom portion.

22. A method of assembling a food container, said method comprising the steps of:

providing a container having top and bottom parts, said top part being pivotably movable towards and away from said bottom part to define closed and open configurations of said container, respectively, front and rear side walls extending between front and rear edge portions of the top and bottom parts, respectively, first and second generally upright side walls extending vertically between opposed pairs of side edge portions of the top and bottom parts, opposite ends of the front side wall along with adjacent front ends of the first and second side walls forming a pair of front corners of the container, and a pair of locking arrangements each disposed adjacent one of the front corners and each having a generally upright locking wall provided on the lower portion of the container, a generally upright locking tab provided on the upper portion of the container, and a generally horizontally oriented tab;

placing a food product on a bottom wall of the bottom part with the container in the open configuration;

closing the container by pivotably moving the top part towards the bottom part and into opposed relation therewith and so that the tabs are each positioned above a respective locking wall; and folding each locking wall inwardly past the respective upright locking tab into a locked position to prevent movement of the top part into the open configuration and to prevent outward movement of the locking wall by an unauthorized user, wherein the tabs block access to the respective locking walls to prevent same from being moved by an unauthorized person outwardly into an unlocked position.

* * * * *

UNITED STATES PATENT AND TRADEMARK OFFICE

CERTIFICATE OF CORRECTION

PATENT NO. : 6,685,085 B2
DATED : February 3, 2004
INVENTOR(S) : David M. Hanna

It is certified that error appears in the above-identified patent and that said Letters Patent is hereby corrected as shown below:

Column 7,
Line 6, change “aid” to -- said --.

Column 8,
Line 21, after “,” insert -- a --.

Signed and Sealed this

Twenty-seventh Day of July, 2004

JON W. DUDAS
*Acting Director of the United States Patent and Trademark Office*